US006250590B1

(12) United States Patent
Hofestadt et al.

(10) Patent No.: US 6,250,590 B1
(45) Date of Patent: Jun. 26, 2001

(54) MOBILE TRAIN STEERING

(75) Inventors: Holm Hofestadt, Sickte; Wolfgang Mücke, Vechelde, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/341,805

(22) PCT Filed: Jan. 16, 1998

(86) PCT No.: PCT/DE98/00188

§ 371 Date: Oct. 22, 1999

§ 102(e) Date: Oct. 22, 1999

(87) PCT Pub. No.: WO98/31580

PCT Pub. Date: Jul. 23, 1998

(30) Foreign Application Priority Data

Jan. 17, 1997 (DE) ..... 197 02 821
Mar. 7, 1997 (DE) ..... 197 11 130

(51) Int. Cl.[7] ..... B61L 3/00
(52) U.S. Cl. ..... 246/167 R
(58) Field of Search ..... 246/2 R, 6, 7, 246/14, 2 F, 2 S, 27, 28 R, 62, 122 R, 124, 167 R, 177, 182 R, 182 B, 182 C, 186, 187 R, 192 R, 473 R; 701/19, 20, 207

(56) References Cited

U.S. PATENT DOCUMENTS 5,487,516 * 1/1996 Murata et al. ..... 246/182 C
5,893,043 * 4/1999 Moehlenbrink et al. ..... 701/207
5,924,653 * 7/1999 Pedersen et al. ..... 246/167 R

FOREIGN PATENT DOCUMENTS 195 29 374 2/1997 (DE) .
0 164 302 12/1985 (EP) .
WO 96/06766 3/1996 (WO) .

OTHER PUBLICATIONS

Database WPI, Section PQ, Week 9626, XP002066209 & JP 08 104 234 A (Tokai Ryokyaku Tetusdo KK) (no date).

* cited by examiner

*Primary Examiner*—Mark T. Le
(74) *Attorney, Agent, or Firm*—Kenyon & Kenyon

(57) ABSTRACT

A method for mobile control of a rail vehicle, in which a track route is determined using a timetable and train number assigned to the rail vehicle. A route request ensures from the vehicle depending on the actual vehicle data. A high degree of automatization in train control is thus obtained.

4 Claims, 1 Drawing Sheet

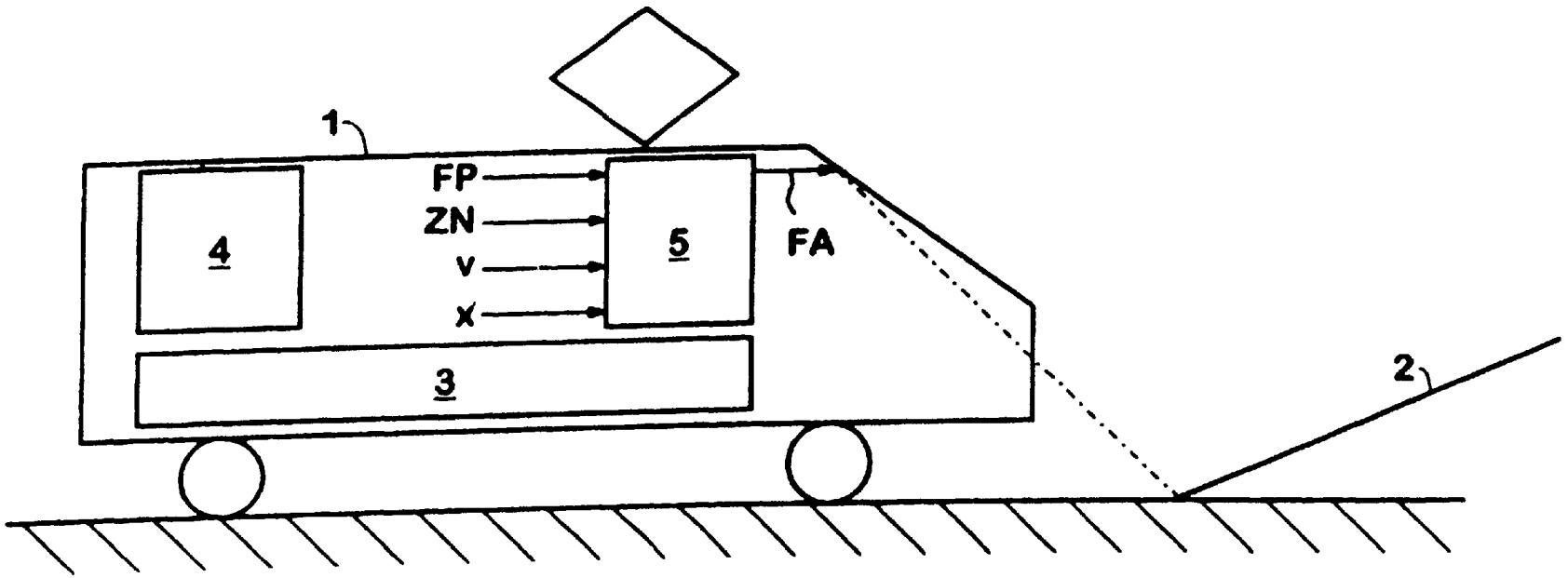
1
2
3
4
5
FA
FP
ZN
V
X

MOBILE TRAIN STEERING

FIELD OF THE INVENTION

The present invention relates to a method of mobile train steering of a rail vehicle.

BACKGROUND INFORMATION

As a rail vehicle or train approaches a signal box with an automatic control function, the control route for passage, which is customary at the following signal box, is set automatically for this train. This form of automatic control operation can be initiated or discontinued by the station master. However, no higher level of automation is possible with this type of operation because the signal box does not know the identity of the train.

In one form of operation with a comparatively high degree of automation, a train steering is provided that is either integrated centrally into a control center or installed in a decentralized location near a signal box. Route tracking and route information for the specific train number are needed as the basis for the train steering. Thus, at the correct time, the train steering can set the intended route according to the schedule. In contrast with automatic control operation, the train steering in the selection of the route may be limited to the arrival if the train trip ends at the following train station. In addition, fault processing, e.g., in the form of an alternate track, may optionally be incorporated into the train steering. This form of operation of the central or decentralized train steering is based on previous signal box technology.

SUMMARY

An object of the present invention is to provide a method of mobile train steering with a high degree of automation.

In accordance with an example embodiment of the present invention, a route is determined on the basis of a schedule assigned to the rail vehicle and its train number, with a route request being made at the vehicle end as a function of instantaneous vehicle data.

The mobile train steering may be part of mobile control and instrumentation technology which is accommodated in a vehicle device or as additional intelligence to the vehicle device in the rail vehicle. The mobile control and instrumentation technology utilizes an existing mobile communications system and existing display and operating equipment in the engineer's cab.

In mobile train steering, the rail vehicle is self-locating and knows its own identity. Therefore, the route intended for this rail vehicle according to the schedule can be set at the proper time. The prerequisite is the existence of a scheduled route in the vehicle device of the rail vehicle. That schedule or any schedule can be loaded section by section, for example, into the mobile train steering at the vehicle end by radio transmission during a trip or immediately before the start of a trip. As an alternative, the entire period schedule of the rail vehicle can be loaded promptly before a schedule change. By entering the train number into the vehicle device, the latter then automatically selects the proper schedule from all the schedules.

On the condition that the basic functionality and train security function are already present on the rail vehicle, the mobile train steering is merely an extra module at the vehicle end in addition to the pre-existing functionality. On the basis of the train number and the schedule, any particularities with regard to the route request, e.g., a stop of a few minutes, in addition to the route are determined. The time of the route request is preferably determined on the basis of the velocity and the location of the rail vehicle, so that the route request can be output at the latest possible time.

The advantages achieved with the present invention include, for example, the fact that the train steering is distributed among multiple vehicle devices by this mobile train steering in addition to achieving an especially high degree of automation in contrast with a central train steering, so this system is especially fail-safe. Thus, in the event of a failure of one vehicle device, only the corresponding rail vehicle is affected by the failure. Furthermore, in a failure of the control center, train operation can be maintained without disruption for a considerable period of time. In addition, due to the distribution of the train steering, the especially great complexity of the entire train steering system can be controlled comparatively easily, with the additions and changes being limited to easily handled subsystems. Furthermore, with mobile train steering, the computer load required for general train steering is distributed among a plurality of devices.

BRIEF DESCRIPTION OF THE DRAWINGS

The FIGURE shows schematically a rail vehicle with a module for mobile train steering, according to an example embodiment of the present invention.

The FIGURE shows a rail vehicle 1 before a route junction 2. Rail vehicle 1 has a module 5 for mobile train steering in addition to a vehicle device 3, which is usually provided, and a mobile train security 4.

Module 5 for the mobile train steering receives as input variables the or any schedule FP and train number ZN as well as instantaneous velocity v and instantaneous train location x of rail vehicle 1. Module 5 determines a respective route request FA from this instantaneous vehicle data FP, ZN, v, x. The respective route and any particularities with regard to route request FA are determined on the basis of train number ZN and schedule FP. The respective time for route request FA is preferably determined on the basis of train location x and velocity v.

Route request FA is output as late as possible in order not to bind unnecessary resources to claimed rail vehicle 1 prematurely. However, route request FA is output promptly to avoid any braking because of a stop signal. For example, a route request FA is output one minute before reaching route junction 2.

In the event rail vehicle 1 is to take a different route than that entered in schedule FP, the motor vehicle driver can manually request the desired route in due time. The station master of a control center can also influence the mobile train steering by activating or deactivating it for a specific train or a specific station. Such activation or deactivation is relayed by radio to the line devices or to vehicle device 3. Another possibility of intervention is early manual setting of the route by the station master before the mobile train steering has requested the route. If in general a request for a route differing from the schedule is made manually by the station master, a signal box is to be provided instead of mobile train security 4.

What is claimed is:

1. A method of mobile train steering of a self-locating rail vehicle, comprising the steps of:

determining at the rail vehicle a route as a function of a schedule assigned to the rail vehicle and a train number assigned to the rail vehicle; and making a route request at the rail vehicle.

2. The method according to claim 1, wherein the schedule is relayed to the rail vehicle.

3. The method according to claim 1, wherein a time of the route request is determined as a function of a velocity of the rail vehicle and a location of the rail vehicle.

4. The method according to claim 1, wherein:

the route request is made as a function of the schedule, the train number, a velocity of the rail vehicle, and a location of the rail vehicle.

* * * * *